US009500058B2

(12) United States Patent
Tunc et al.

(10) Patent No.: US 9,500,058 B2
(45) Date of Patent: Nov. 22, 2016

(54) COILED TUBING TRACTOR ASSEMBLY

(75) Inventors: Gokturk Tunc, Stafford, TX (US); Cecilia Prieto, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 11/923,895

(22) Filed: Oct. 25, 2007

(65) Prior Publication Data

US 2008/0073077 A1 Mar. 27, 2008

Related U.S. Application Data

(63) Continuation-in-part of application No. 11/135,314, filed on May 23, 2005, now Pat. No. 7,617,873, which is a continuation-in-part of application No. 11/772,181, filed on Jun. 30, 2007, now abandoned.

(60) Provisional application No. 60/575,327, filed on May 28, 2004, provisional application No. 60/883,115, filed on Jan. 2, 2007.

(51) Int. Cl.

| | |
|---|---|
| ***E21B 23/14*** | (2006.01) |
| ***E21B 47/12*** | (2012.01) |
| *E21B 23/00* | (2006.01) |

(52) U.S. Cl.

CPC ..... *E21B 23/14* (2013.01); *E21B 47/123* (2013.01); *E21B 2023/008* (2013.01)

(58) Field of Classification Search

CPC ..... E21B 4/18; E21B 19/08; E21B 19/086; E21B 19/22; E21B 2023/008; E21B 23/01; E21B 23/04; E21B 23/14; E21B 47/123

USPC ..... 175/51, 97, 99; 166/250.01, 212, 241.1

See application file for complete search history.

(56) References Cited

U.S. PATENT DOCUMENTS

| | | | |
|---|---|---|---|
| 2,558,427 | A | 6/1951 | Fagan |
| 4,859,054 | A | 8/1989 | Harrison |
| 5,332,048 | A | 7/1994 | Underwood et al. |
| 5,434,395 | A | 7/1995 | Storck et al. |

(Continued)

FOREIGN PATENT DOCUMENTS

| | | | |
|---|---|---|---|
| DE | 2818656 | A1 | 10/1979 |
| DE | 29816469 | U1 | 2/1999 |

(Continued)

OTHER PUBLICATIONS

Esteban, et al., "Measurement of the Degree of Salinity of Water with a Fiber-Optic Sensor", Applied Optics, vol. 38 (25), Sep. 1999, pp. 5267-5271.

(Continued)

*Primary Examiner* — Elizabeth Gitlin
(74) *Attorney, Agent, or Firm* — Jeffrey R. Anderson; Michael L. Flynn; Tim Curington

(57) ABSTRACT

A coiled tubing tractor assembly including a hydraulically powered tractor coupled to a coiled tubing having a fiber optic therethrough to provide communicative means, for example, to a monitor coupled to the tractor. The fiber optic may also be employed to control movement of the coiled tubing tractor. Additionally, a diagnostic tool may be coupled to the tractor wherein the tractor provides a communicative link between the diagnostic tool and the monitoring device.

20 Claims, 6 Drawing Sheets

(56) References Cited

U.S. PATENT DOCUMENTS

| | | | | |
|---|---|---|---|---|
| 5,485,745 | A * | 1/1996 | Rademaker | E21B 17/203 340/854.7 |
| 5,542,471 | A | 8/1996 | Dickinson | |
| 5,573,225 | A | 11/1996 | Boyle et al. | |
| 5,992,250 | A | 11/1999 | Kluth et al. | |
| 6,009,216 | A | 12/1999 | Pruett | |
| 6,082,461 | A | 7/2000 | Newman et al. | |
| 6,089,323 | A | 7/2000 | Newman et al. | |
| 6,157,893 | A | 12/2000 | Berger et al. | |
| 6,192,983 | B1 | 2/2001 | Neuroth et al. | |
| 6,241,031 | B1 * | 6/2001 | Beaufort et al. | 175/99 |
| 6,247,536 | B1 | 6/2001 | Leismer et al. | |
| 6,273,189 | B1 | 8/2001 | Gissler et al. | |
| 6,281,489 | B1 | 8/2001 | Tubel et al. | |
| 6,347,674 | B1 * | 2/2002 | Bloom et al. | 175/51 |
| 6,349,768 | B1 | 2/2002 | Leising | |
| 6,367,366 | B1 | 4/2002 | Bloom et al. | |
| 6,419,014 | B1 | 7/2002 | Meek et al. | |
| 6,427,786 | B2 | 8/2002 | Beaufort et al. | |
| 6,464,003 | B2 | 10/2002 | Bloom et al. | |
| 6,467,557 | B1 | 10/2002 | Krueger et al. | |
| 6,474,152 | B1 | 11/2002 | Mullins et al. | |
| 6,478,097 | B2 | 11/2002 | Bloom et al. | |
| 6,519,568 | B1 | 2/2003 | Harvey et al. | |
| 6,581,455 | B1 | 6/2003 | Berger et al. | |
| 6,629,568 | B2 | 10/2003 | Post et al. | |
| 6,640,894 | B2 | 11/2003 | Bloom et al. | |
| 6,667,280 | B2 | 12/2003 | Chang et al. | |
| 6,679,341 | B2 | 1/2004 | Bloom et al. | |
| 6,715,559 | B2 | 4/2004 | Bloom et al. | |
| 6,745,854 | B2 | 6/2004 | Bloom et al. | |
| 6,789,621 | B2 | 9/2004 | Wetzel et al. | |
| 6,817,410 | B2 | 11/2004 | Wetzel et al. | |
| 6,868,906 | B1 | 3/2005 | Vail, III et al. | |
| 6,935,423 | B2 | 8/2005 | Kusmer | |
| 6,938,708 | B2 | 9/2005 | Bloom et al. | |
| 7,048,047 | B2 | 5/2006 | Bloom et al. | |
| 7,080,700 | B2 | 7/2006 | Bloom et al. | |
| 7,080,701 | B2 | 7/2006 | Bloom et al. | |
| 7,121,364 | B2 | 10/2006 | Mock et al. | |
| 7,124,819 | B2 * | 10/2006 | Ciglenec et al. | 166/264 |
| 7,152,685 | B2 | 12/2006 | Adnan et al. | |
| 7,174,974 | B2 | 2/2007 | Bloom et al. | |
| 7,182,134 | B2 | 2/2007 | Wetzel et al. | |
| 7,207,216 | B2 | 4/2007 | Meister et al. | |
| 7,617,873 | B2 | 11/2009 | Lovell et al. | |
| 2002/0007945 | A1 | 1/2002 | Neuroth et al. | |
| 2002/0029908 | A1 | 3/2002 | Bloom | |
| 2002/0104686 | A1 | 8/2002 | Bloom | |
| 2002/0125008 | A1 | 9/2002 | Wetzel et al. | |
| 2003/0075361 | A1 | 4/2003 | Terry et al. | |
| 2003/0116356 | A1 | 6/2003 | Bloom | |
| 2003/0121703 | A1 | 7/2003 | Bloom | |
| 2003/0188875 | A1 | 10/2003 | Bloom | |
| 2004/0045705 | A1 | 3/2004 | Gardner et al. | |
| 2004/0084190 | A1 | 5/2004 | Hill et al. | |
| 2004/0129418 | A1 | 7/2004 | Jee et al. | |
| 2004/0245018 | A1 | 12/2004 | Bloom | |
| 2005/0016730 | A1 | 1/2005 | McMechan et al. | |
| 2005/0082055 | A1 | 4/2005 | Bloom | |
| 2005/0247488 | A1 | 11/2005 | Mock | |
| 2005/0252686 | A1 | 11/2005 | Bloom | |
| 2006/0196694 | A1 | 9/2006 | Bloom | |
| 2006/0196696 | A1 | 9/2006 | Bloom | |
| 2007/0137860 | A1 * | 6/2007 | Lovell et al. | 166/250.01 |
| 2007/0215345 | A1 * | 9/2007 | Lafferty et al. | 166/250.1 |

FOREIGN PATENT DOCUMENTS

| | | | |
|---|---|---|---|
| EA | 9704 | B1 | 2/2008 |
| EP | 203249 | A2 | 12/1986 |
| EP | 853249 | A1 | 7/1998 |
| EP | 0911483 | B1 | 8/2006 |
| GB | 2177231 | A | 1/1987 |
| GB | 2275953 | | 9/1994 |
| GB | 2299868 | A | 10/1996 |
| GB | 2346908 | | 8/2000 |
| GB | 2351308 | | 12/2000 |
| GB | 2362405 | | 11/2001 |
| GB | 2370056 | | 6/2002 |
| GB | 2378468 | | 2/2003 |
| GB | 2378469 | | 2/2003 |
| GB | 2380755 | | 4/2003 |
| GB | 2389135 | | 12/2003 |
| GB | 2413816 | | 11/2005 |
| GB | 2414499 | | 11/2005 |
| WO | 9708418 | A1 | 3/1997 |
| WO | 0036266 | | 6/2000 |
| WO | 0046481 | | 8/2000 |
| WO | 0109478 | | 2/2001 |
| WO | 0109478 | A1 | 2/2001 |
| WO | 0244509 | | 6/2002 |
| WO | 2004072433 | | 8/2004 |
| WO | 2005090739 | | 9/2005 |
| WO | 2005116388 | A1 | 12/2005 |
| WO | 2008081404 | A1 | 7/2008 |

OTHER PUBLICATIONS

Maher, et al., "A Fiber Optic Chemical Sensor for Measurement of Groundwater pH", Journal of Testing and Evaluation, vol. 21 (5), Sep. 1993, 5 pages.

Wolfbeis, et al., "Fiber Optic Fluorosensor for Oxygen and Carbon Dioxide", Anal. Chem, vol. 60, 1998, pp. 2028-2030.

* cited by examiner

COILED TUBING TRACTOR ASSEMBLY

CROSS REFERENCE TO RELATED APPLICATIONS

This Patent Document is a continuation-in-part claiming priority under 35 U.S.C. §120 to U.S. application Ser. No. 11/135,314 entitled Systems and Methods Using Fiber Optics in Coiled Tubing, filed on May 23, 2005 now U.S Pat. No. 7,617,873, incorporated herein by reference in its entirety and also in turn claiming priority to U.S. Provisional App. Ser. No. 60/575,327 filed May 28,2004. This Patent Document is also a continuation-in-part claiming priority under 35 U.S.C. §120 to U.S. application Ser. No. 11/772,181 entitled Hydraulically Driven Tractor, filed on Jun. 30, 2007 now abandoned which is also incorporated herein by reference in its entirety and further claims priority to U.S. Provisional App. Ser. No. 60/883,115 filed Jan. 2, 2007.

FIELD

Embodiments described relate to tractors for advancing coiled tubing and other equipment through an underground well. In particular, embodiments of tractors are described that are hydraulically powered and coupled to a fiber optic line through coiled tubing to provide communicative and/or controlling means thereto.

BACKGROUND

Coiled tubing operations may be employed at an oilfield to deliver a downhole tool to an operation site for a variety of well intervention applications such as well stimulation, the creating of perforations, or the clean-out of debris from within the well. Coiled tubing operations are particularly adept at providing access to highly deviated or tortuous wells where gravity alone fails to provide access to all regions of the wells. During a coiled tubing operation, a spool of pipe (i.e., a coiled tubing) with a downhole tool at the end thereof is slowly straightened and forcibly pushed into the well. For example, a clean out tool may be delivered to a clean out site within the well in this manner to clean out sand or other undesirable debris thereat.

Unfortunately, the coiled tubing is susceptible to helical buckling as it is pushed deeper and deeper into the well. That is, depending on the degree of tortuousness and the well depth traversed, the coiled tubing will eventually buckle against the well wall and begin to take on the character of a helical spring. In such circumstances, continued downhole pushing on the coiled tubing simply lodges it more firmly into the well wall ensuring its immobilization and potentially damaging the coiled tubing itself. This has become a more significant matter over the years as the number of tortuous or deviated extended reach wells have become more prevalent. Thus, in order to extend the reach of the coiled tubing, a tractor may be incorporated into a downhole portion thereof for pulling the coiled tubing deeper into the well.

Tractoring and advancement of the coiled tubing through the well is directed by an operator from the surface of the oilfield. Generally this takes place without information provided to the surface as to the status of the operation at the site of the tractor downhole. That is, the real-time acquisition and transfer of data between the area of the tractor and the surface is generally lacking due to challenges involved in acquiring and transferring the data. For example, mud pulse telemetry or the use of wireline cables between a diagnostic tool at the tractor and the surface may be employed to provide well condition information to an operator. However, in the case of mud pulse telemetry, a temporary obstruction in the well is required in order to transmit a fluid pulse uphole. Additionally, data collection may be limited and the system quite complex. Therefore, mud pulse telemetry is generally not employed. On the other hand, the placement of wireline cables all the way through the coiled tubing and to a diagnostic tool at the tractor location presents several challenges as well. For example, wireline cables are difficult to run through the coiled tubing, take up considerable amount of space within the inner diameter of the coiled tubing, may significantly increase the total weight of the coiled tubing equipment, and present challenges related to tension and control compatibility between the separate wireline and coiled tubing lines themselves.

SUMMARY

In order to address challenges with conventional data transmission between the downhole environment and an oilfield surface, fiber optic communication may be employed. That is, a fiber optic cable may be provided between the surface and a diagnostic tool positioned downhole in a well. In this manner, well information obtained by the diagnostic tool may be transmitted back uphole by fiber optics for analysis. Unlike the above noted wireline cable, a fiber optic cable may be significantly smaller, lighter and easier to insert through the coiled tubing. It may also be readily compatible with wireless transmission means at the surface, thus, making its merging with the coiled tubing at the surface even easier. Furthermore, the inner diameter of the coiled tubing is not significantly compromised by the presence of the small diameter fiber optic cable. Due to its comparatively small weight, the fiber optic cable also fails to present significant incompatibility in terms of differing tensions between itself and the coiled tubing.

As such, in one embodiment a coiled tubing tractor assembly is provided with a tractor coupled to a coiled tubing having a fiber optic cable therethrough. In one embodiment the fiber optic cable terminates at the monitoring device. The fiber optic cable may also be used to control movement of the coiled tubing tractor. Additionally, a tool may be coupled to the coiled tubing tractor wherein the coiled tubing tractor provides communicative means between the tool and the monitoring device.

DETAILED DESCRIPTION

Embodiments are described with reference to certain downhole tractor assemblies for use in a well at an oilfield. In particular, dual anchor reciprocating tractor embodiments are described. However, a variety of configurations may be employed. Regardless, embodiments described may include a coiled tubing tractor with a diagnostic tool coupled thereto for fiber optic communication with surface equipment at the oilfield. In fact, the tractor itself may be responsive to fiber optic communications from surface equipment. Furthermore, such communications may even be delivered to downhole tools downhole of the tractor and coupled thereto.

Figure 1:
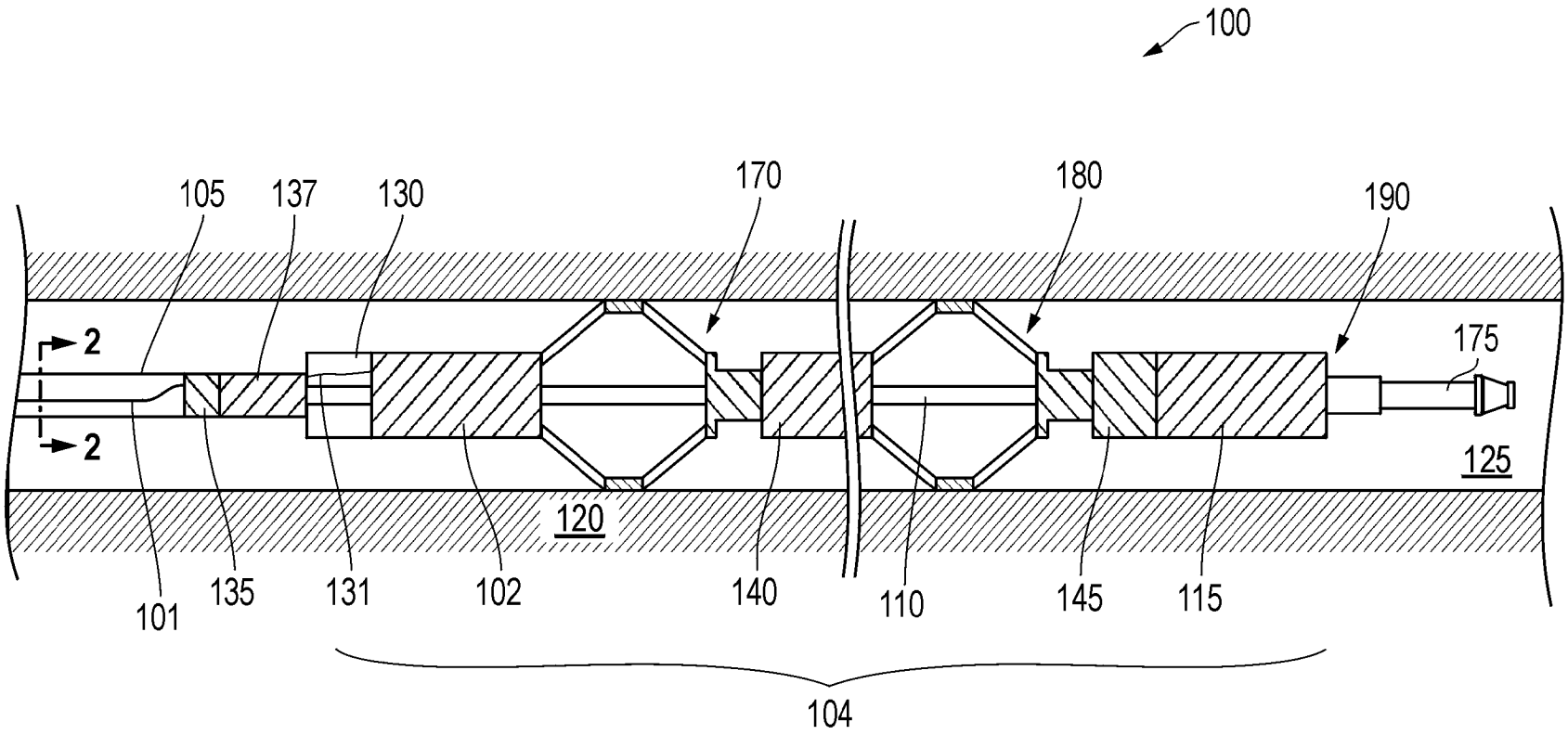
FIG. 1 is a side cross-sectional view of an embodiment of a coiled tubing tractor assembly with a tractor having diagnostic and downhole tools coupled thereto and disposed within a well.

Referring now to FIG. 1 an embodiment of a bottom hole assembly 100 is shown disposed within a downhole region 120 of a well 125. The bottom hole assembly 100 may be directed to this location to aid in hydrocarbon recovery efforts from the downhole region 120, for example, as detailed with reference to FIG. 7 below. The bottom hole assembly 100 includes a coiled tubing tractor 104 with adjacent anchors 170, 180. These anchors 170, 180 may be employed to achieve tractor advancement within the well 125 as detailed further below.

Figure 7:
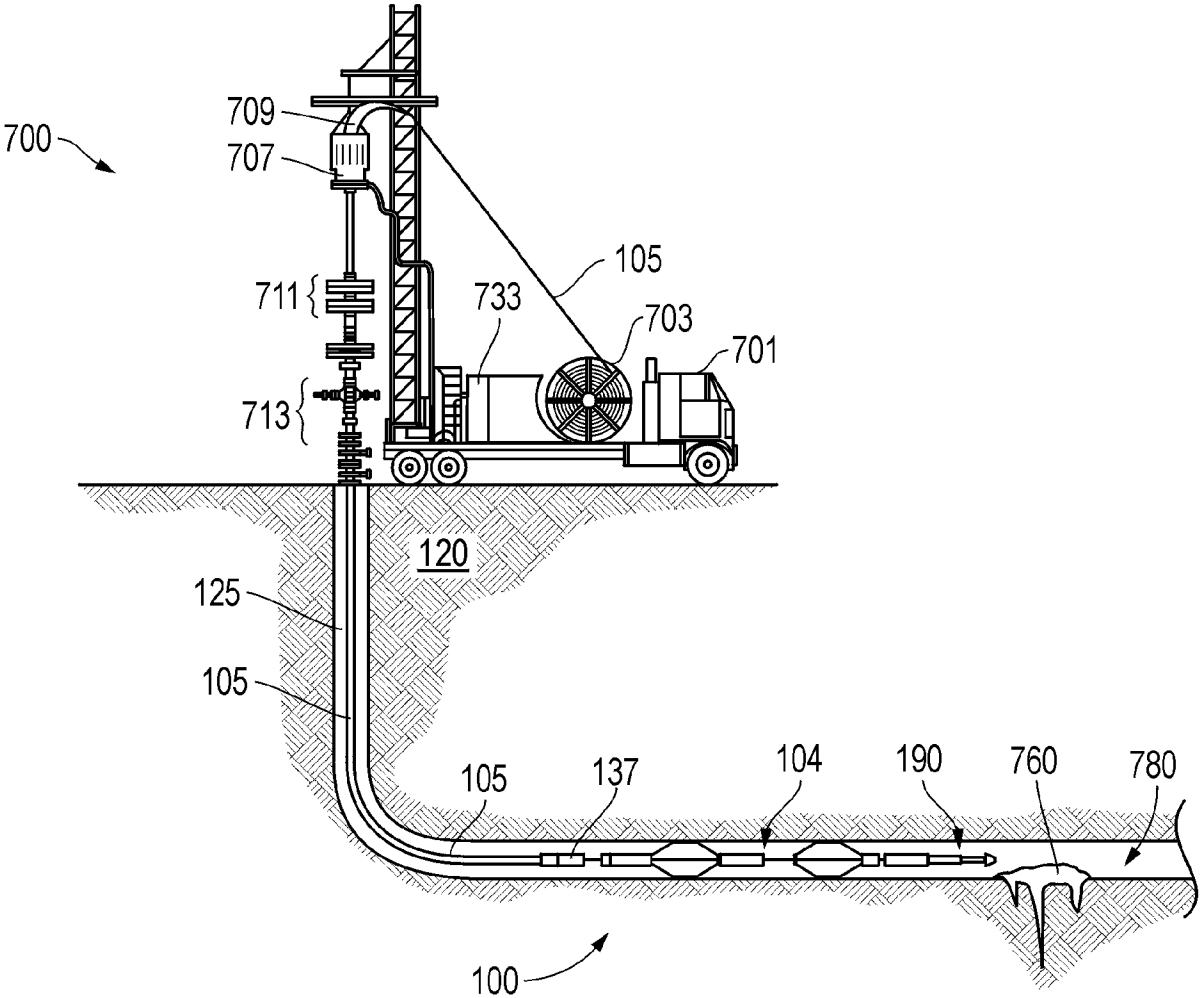
FIG. 7 is a depiction of the assembly of FIG. 1 employed in an operation at an oilfield.

An uphole end of the above noted tractor 104 is ultimately coupled to coiled tubing 105 for a coiled tubing operation that may be directed by equipment above the well, for example, from an oilfield surface 700 (see FIG. 7). In this manner, advancement of the coiled tubing tractor 104 in a downhole direction may be employed to also pull the coiled tubing 105 in a downhole direction. This may be particularly advantageous in the case of a highly deviated or horizontal well wherein pushing the coiled tubing 105 alone, by surface equipment, into the well 125 may ultimately yield a fairly limited total attainable well depth.

Continuing with reference to FIG. 1, a fiber optic cable 101 is revealed running through the coiled tubing 105 to provide two-way communication, for example, from the above noted surface equipment. The fiber optic cable 101 is a line or tether which may weigh no more than about 0.01 lbs./ft. and include an outer diameter of about 0.15 inches or less. This is in sharp contrast to a conventional electrically conductive cable which may weigh more than about 0.25 lbs./ft. and have a profile of about 0.3 inches or more in outer diameter. Thus, employing the fiber optic cable 101 for communications adds comparatively negligible weight to the overall assembly 100. Furthermore, the coiled tubing 105 may be much larger than the cable 101, for example having an inner diameter of between about 1 about 3 inches. Thus, the fiber optic cable 101 also leaves an interior or fluid flow path 201 (see FIG. 2) of the coiled tubing 105 substantially less affected, for example, in terms of volume availability for fluid flow as described further below.

As shown in FIG. 1, a diagnostic tool 137 and signal converter 135 are disposed between the tractor 104 and the coiled tubing 105 such that the above noted fiber optic cable 101 actually terminates at the converter 135. The signal converter 135 may be a conventional conversion device for translating fiber optic signals into electrical signals and vice versa. Thus, it may be employed to obtain and convert fiber optic communications from the cable 101 into electrical signals that may be understood by the diagnostic tool 137 or other electrically compatible downhole equipment. Similarly, data in the form of electrical signals that is routed to the converter 135 from the diagnostic tool 137 or other electrically compatible downhole equipment may be transported as fiber optic signal uphole along the fiber optic cable 101.

The diagnostic tool 137 may be employed to acquire downhole information for transmission back up the fiber optic cable 101 to surface equipment where it may be analyzed and employed in real time during an ongoing well application performed by the assembly 100. Such an application may be achieved with a downhole tool 190 such as for a clean out application wherein the downhole tool 190 includes a clean out nozzle 175 as detailed further below (see FIG. 7). Additionally, stimulation, fracturing, milling, fishing, perforating, logging, and other well applications may be performed with the depicted embodiment or alternate embodiments of the assembly 100. Data acquired by the diagnostic tool 137 for use in such applications may include pressure, temperature, pH, particle concentration, viscosity, compression, tension, density, photographic, and depth or location information, among other desired downhole data. Furthermore, aside from the diagnostic tool 137 depicted, alternate sensors located elsewhere throughout the assembly 100 may be employed to acquire such information for transmission to the converter 135 and ultimately up the fiber optic cable 101.

Given that the above described fiber optic cable 101 may be used in place of an electrical cable for transmission of data, large power requirements of the assembly 100 may be met with hydraulic power as detailed further below. Smaller power requirements on the other hand, such as for electrically compatible components like the above noted diagnostic tool 137 or solenoids 401, 402, 403, 500, 510 (see FIGS. 4 and 5), may be provided by a mobile battery 130. Additionally, a microprocessor coupled to the battery 130 may be employed to coordinate the solenoid activity. Sensor data and operator input may similarly be accounted for by the microprocessor. In the embodiment shown, the mobile battery 130 is positioned at the uphole end of the tractor 104 on an uphole housing 102 thereof. However, the mobile battery 130 may be located in a variety of positions on the tractor 104, at a downhole tool 190, on the diagnostic tool 137, at the downhole portion of the coiled tubing 105, or at any other suitable downhole location of the assembly 100. Indeed, multiple mobile batteries may be located at downhole locations of the assembly 100, for separately supplying power to different electronically compatible downhole components of the assembly 100.

In one embodiment, the mobile battery 130 may be a lithium based power source with a protective covering for the downhole environment. Such a battery 130 may be configured to supply up to about 100 watts of power or more and be more than capable of meeting the power needs of electrically compatible components such as the diagnostic tool 137. In the embodiment shown, an electric wire 131 is depicted coupling the mobile battery 130 to the diagnostic tool 137. However, additional electric wires may be provided linking the mobile battery 130 to other electrically compatible components of the assembly 100 (e.g. see wiring 501 of FIG. 5).

Continuing again with reference to FIG. 1, each anchor 170, 180 is coupled to a housing 102, 115 and an actuator 140, 145 therefor. A piston 110 is provided that is ultimately coupled uphole to the coiled tubing 105, via the diagnostic tool 137 and converter 135 in the embodiment shown. The piston 110 runs through the anchors 170, 180, the actuators 140, 145 and the housings 102, 115 as it is employed to hydraulically drive the tractor 104 and pull coiled tubing 105 through the well 125 as detailed further below.

As indicated, the bottom hole assembly 100 may be particularly adept at traversing highly deviated extended reach wells by employment of the coiled tubing tractor 104. In fact, as detailed in FIGS. 6A-6C, the tractor 104 may be configured for continuous advancement of the piston 110 noted above in order to achieve continuous downhole movement of the entire assembly 100. This continuous downhole movement may dramatically increase the attainable well depth of the assembly 100. For example, conventional coiled tubing 105 that is spooled at the well surface and coupled to the piston 110 of a tractor 104 capable of supplying five thousand pounds of force may be advanced in excess of five thousand feet further through a tortuous well 125 due to use of such a continuous movement tractor 104.

Power requirements for achieving the above noted continuous movement of the tractor 104 may be obtained through hydraulics drawn from available pumped fluid through the coiled tubing 105 during an operation. As indicated above, the presence of the fiber optic cable or tether 101 (in the fluid flow path 201 of the coiled tubing 105) during pumping of the fluid negligibly effects movement of the fluid through the assembly 100. Thus, the higher power requirements of the tractor 104, perhaps in the 4,000 to 6,000 watt range, may be readily met in this manner. With continued reference to FIG. 1, certain features of such a hydraulically powered tractor 104 have been introduced here. However, the hydraulic powering details are further expounded upon in reference to FIGS. 4, 5, and 6A-6B detailed below.

Figure 2:
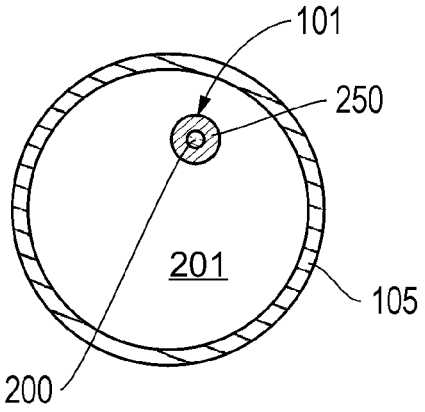
FIG. 2 is a cross-sectional view of coiled tubing and a fiber optic cable of the assembly of FIG. 1 taken from section lines 2-2.

Referring now to FIG. 2, a cross-sectional view of the coiled tubing 105 and fiber optic cable 101 is depicted, taken from section lines 2-2 of FIG. 1. The fiber optic cable or tether 101 may include a fiber optic core 200 encased in a protective jacket 250 to shield the core 200 from downhole conditions and help ensure adequate signal transmission capacity therethrough. As indicated above, the cable or tether 101 may have an outer diameter of less than about 0.15 inches whereas the inner diameter of the coiled tubing 105 may be between about 1 and about 3 inches. Thus, an interior or fluid flow path 201 of the coiled tubing 105 remains substantially unaffected by the presence of the cable 101 as indicated above, for example, during pumping of a fluid through the coiled tubing 105.

While the fiber optic cable 101 provides communicative capacity from surface equipment down to the converter 135, communicative capacity may be extended further downhole beyond the interface of the fiber optic cable 101 and converter 135. For example, as noted above and depicted in FIG. 3, a signal pathway is depicted. The pathway may include an electric wire 131 to provide communicative capacity downhole beyond the converter 135 and diagnostic tool 137, for example to the downhole tool 190 shown. The same or similar electrical wiring may lead from the converter 135, or other components wired thereto, in order to provide communicative capacity to other such components elsewhere throughout the assembly 100 of FIG. 1. Additionally, a microprocessor may be incorporated with the diagnostic tool for real-time data processing of the collected data.

It is worth noting that the converter 135 is provided to extend downhole communicative capacity in light of the fact that many conventional downhole tools and components are at present electrically, as opposed to fiber optically, compatible in terms of data transmission. However, this is not required and in alternate embodiments, the fiber optic cable 101 may actually extend to fiber optically compatible features. For example, while the downhole tool 190 may be powered by hydraulics and perhaps an associated mobile battery 130 (see FIG. 1), in one embodiment, it may nevertheless be controlled by signals transmitted directly from the fiber optic cable 101 to the tool 190. This may occur by coupling of a branch of the cable 101 directly to the downhole tool 190 or alternatively by conventional wireless means similar to that noted below.

Figure 3:
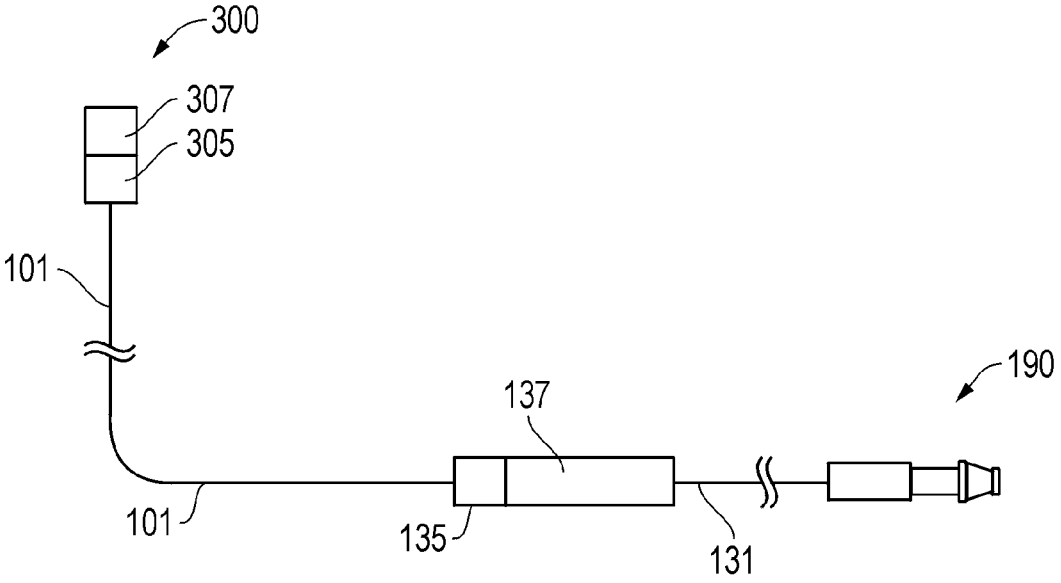
FIG. 3 is a schematic overview of the assembly of FIGS. 1 and 2 revealing a communicative pathway from surface equipment through the fiber optic cable and to the diagnostic and downhole tools.

Continuing with reference to FIG. 3, with added reference to FIG. 7, the fiber optic cable 101 is shown originating from optical surface equipment 300 including a conventional fiber optic light source 305 and a wireless transceiver 307. In this manner, data transmission may take place wirelessly between other surface data processing equipment and a surface portion of the cable 101 (e.g. at the coiled tubing reel 703). Employing wireless communication in this way at the oilfield surface may reduce the physical complexity of maintaining threaded fiber optic cable 101 through coiled tubing 105 on a reel 703 during advancement into the well 125.

Figure 4:
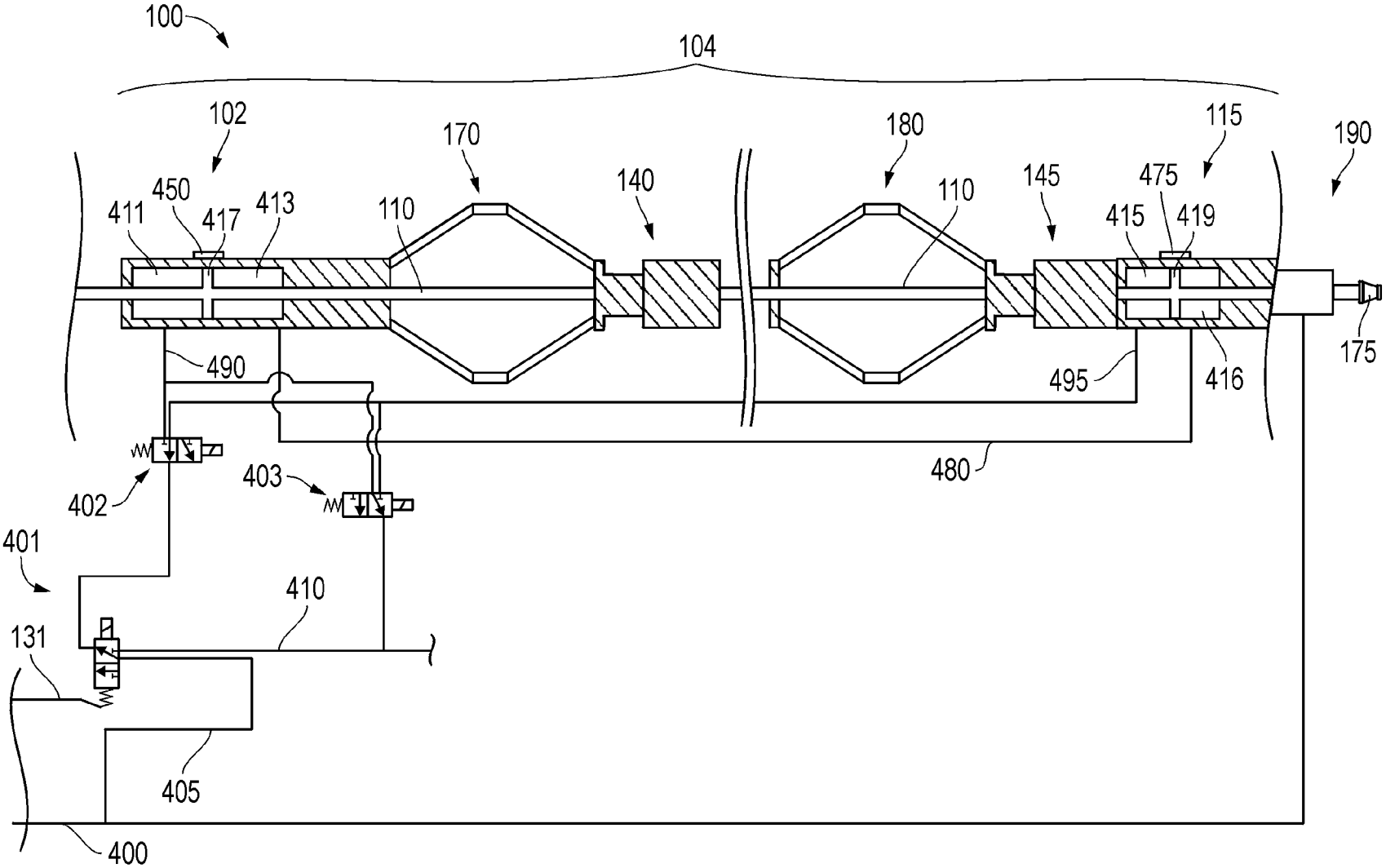
FIG. 4 is a side cross-sectional view of the assembly of FIG. 1 with a comparative depiction of powering hydraulics therebelow.

Continuing now with reference to FIGS. 1 and 4, the first anchor 170, referred to herein as the uphole anchor 170, may act in concert with the adjacent uphole actuator 140 to contact a well wall to achieve immobilization. This immobilization may take place in a centralized manner. Furthermore, centralization may occur prior to the immobilization, with the anchor 170 in contact with the well wall but in a mobile state, thereby decreasing the amount of time required to achieve complete immobilization. Regardless, the uphole housing 102 may be coupled to the uphole actuator 140. Therefore, as depicted in FIG. 1 and detailed below, the uphole housing 102 may play an important role in the positioning of the uphole anchor 170 and the piston 110 relative to one another.

The downhole anchor 180 may similarly act in concert with an adjacent downhole actuator 145 to achieve immobilization with respect to the well wall, which may again include centralization. Likewise, a downhole housing 115 may also play an important role in the positioning of the downhole anchor 180 and the piston 110 relative to one another. As alluded to above, for the embodiments described herein, the anchors 170, 180 may be deployed for centralizing when not in a state of immobilization. With such constant deployment, the time between lateral mobility and full immobilization may be significantly reduced for a given anchor 170, 180 in response to pressurization conditions as detailed below. However, in embodiments where a more reduced profile is sought for an anchor 170, 180 in a mobile state, such constant deployment is not required.

With particular reference to FIG. 4 and added reference to FIG. 1, the manner in which the tractor 104 is advanced within the well 125 by the advancing anchors 170, 180 is described. FIG. 4, in particular reveals a series of hydraulics between the uphole housing 102 and the downhole housing 115. As detailed further here, these hydraulics are configured such that an influx of hydraulic pressure into one of the housings 102, 115 may lead to a repositioning of the opposite housing 102, 115. As a result, a reliable reciprocating movement of the tractor 104 is achieved without interruption in the forward movement of the piston 110 or any coiled tubing 105 or other equipment coupled thereto.

Continuing with reference to FIG. 4 a downhole pressurization line 495 is coupled to the downhole housing 115. For sake of description here, the downhole pressurization line 495 is presented as a high pressure line for delivering an influx of high pressure to the downhole power chamber 415 from a high pressure line 405 through a series of solenoids 401, 402. However, as described further herein this line 495 may not actually provide pressurization at all times.

The pressurization provided by the downhole pressurization line 495 may arrive in the form of a pressurized hydraulic oil or coiled tubing fluid. For example, in one embodiment, the piston 110 of the tractor 104 is ultimately coupled uphole to the coiled tubing 105 of FIG. 1 that maintains pressurized hydraulic fluid therein. A hydraulic supply line 400 may be provided from which hydraulic fluid is diverted into the high pressure line 405 noted above. In fact, a conventional choke may be positioned in the hydraulic supply line 400 such that a portion of the line at the opposite side of the choke may serve as a low pressure line 410 for purposes detailed below.

As shown in FIG. 4, an activation solenoid 401 coupled to the high pressure line 405 may be directed to the depicted "on" position by communicative means such as the above detailed electric wire 131. In this manner movement of the tractor 104 as detailed below may begin. However, an operator or equipment at the surface of the operation may similarly direct the activation solenoid 401 to an "off" position closing off the high pressure line 405 connecting to the low pressure line 410 and halting movement of the tractor 104. The low pressure line 410 may be of the annulus pressure.

While a variety of pressurization parameters may be employed, for the examples described below, about 2,000 PSI pressure differential, relative to the well 125 of FIG. 1, may be employed to achieve movement of the tractor 104 as detailed. In order to achieve this pressurization, hydraulic fluid may be diverted from the hydraulic supply line 400 into the high pressure line 405 as noted above, and ultimately to the downhole pressurization line 495 (or alternatively to the uphole pressurization line 490 as also noted below).

The piston 110 of the tractor 104 runs entirely therethrough, including through the downhole housing 115 itself. A downhole head 419 of the piston 110 is housed by the downhole housing 115 and serves to separate the downhole power chamber 415 from a downhole return chamber 416 of the housing 115. As indicated above, pressurized hydraulic fluid is delivered to the downhole power chamber 415 by the downhole pressurization line 495. Thus, when the downhole anchor 180 is immobilized as detailed below, the application of sufficient pressure to the downhole piston head 419 may move the piston 110 in a downhole direction. Accordingly, the volume of the return chamber 416 is reduced as the volume of the power chamber 415 grows. For this period, the piston 110 moves in a downhole direction pulling, for example, the coiled tubing 105 of FIG. 1 right along with it.

Of note is the fact that the arms of the downhole anchor 180 may be initially immobilized with trapped hydraulic fluid of about 500 PSI, for example. However, the advancement of the piston 110, pulling up to several thousand feet of coiled tubing 105 or other equipment, may force up to 15,000 PSI or more on the immobilized arms of the anchor 180. Regardless, the arms of the anchor 180 may be of a self gripping configuration only further immobilizing the anchor 180 in place. These arms of the anchor 180 may include a self-gripping mechanism such as responsive cams relative to a well surface as detailed in U.S. Pat. No. 6,629,568 entitled Bi-directional grip mechanism for a wide range of bore sizes, incorporated herein by reference.

As the downhole piston head 419 is forced in the downhole direction as noted above, the volume of the downhole return chamber 416 decreases. Thus, hydraulic fluid therein is forced out of the downhole housing 115 and into a fluid transfer line 480. The fluid transfer line 480 delivers hydraulic fluid to an uphole return chamber 413 of the uphole housing 102. Thus, the high pressure influx of hydraulic fluid from the downhole pressurization line 495 into the downhole power chamber 415 ultimately results in an influx of hydraulic fluid into the uphole housing 102.

The influx of hydraulic fluid into the uphole housing 102 is achieved through the uphole return chamber 413. Thus, it appears as though the hydraulic fluid would act upon an uphole piston head 417 within the uphole housing 102 in order to drive it in an uphole direction. However, as described further below, the uphole anchor 170 may be centralized without being immobilized at this point in time. Thus, an increase in pressure within the uphole return chamber 413 acts to move the entire uphole housing 102 and anchor 170 in a downhole direction. For example, the housing 102 and anchor 170 may require no more than between about 50 and about 300 pounds of force for the indicated downhole moving, whereas moving of the uphole piston head 417 and all of the coiled tubing 105 of FIG. 1 or other equipment coupled thereto would likely require several thousand pounds of force. Therefore, the uphole anchor 170 and housing 102 are moved downhole until the downhole piston head 419 reaches the downhole end of the downhole housing 115 (see also FIG. 6B).

The anchoring and hydraulic synchronization described to this point allow for the continuous advancement of the piston 110. Thus, any equipment, such as the coiled tubing 105 of FIG. 1 that is coupled thereto may be continuously pulled in a downhole direction. This is a particular result of the series hydraulics employed. That is, hydraulic pressure is applied to one of the housings 115 which thereby employs movement of the piston 110 downhole as a corollary to the downhole advancement of the opposite housing 102. There is no measurable interruption in the advancement of the piston 110. For example, the piston 110 need not stop, wait for a housing (e.g. 102) to move and then proceed downhole. Rather, the movement of the piston 110 is continuous allowing the entire tractor 104 to avoid static friction in the coiled tubing that would be present with each restart of the piston 110 in the downhole direction. As detailed below, the advantage of this continuing movement may provide the tractor 104 with up to twice the total achievable downhole depth by taking advantage of the dynamic condition of the moving system.

As detailed above, the transfer of hydraulic pressure takes place from the downhole housing 112 to the uphole housing 115 through the fluid transfer line 480. In particular, pressure from the immobilized dowhole housing 115 is transferred to the mobile uphole housing 102 and anchor 170 to achieve downhole movement thereof, along with the continued advancement of the piston 110. However, at some point, the transfer of pressure from the downhole housing 115 to the uphole housing 102 will reverse. That is, the uphole housing 102 may be immobilized, the downhole housing 115 made mobile, and hydraulic fluid driven from the uphole housing 102 to the downhole housing 115 in order to achieve downhole movement of the downhole housing 115. As detailed below, this switch may take place as the downhole piston head 419 reaches the end of its downhole advancement completing its effect on the shrinking downhole return chamber 416.

A position sensor 475 may be employed to detect the location of the downhole piston head 419 as it approaches the above noted position. For example, in one embodiment, the piston head 419 may be magnetized and the sensor 475 mounted on the housing 115 and including the capacity to detect the magnetized piston head 419 and its location. The sensor 475 may be wired to conventional processing means for signaling and directing a switch solenoid 402 to switch the pressure condition from the downhole pressurization line 495 (as shown in FIG. 4) to the uphole pressurization line 490 as described here. Additionally, another switch solenoid 403 may be directed to switch the low pressure from the uphole pressurization line 490 to the downhole pressurization line 495. Thus, with the uphole anchor 170 now immobilized at this point in time as detailed below, an influx of high pressure into the power chamber 411 of the uphole housing 102 may now drive the uphole piston head 417 in a downhole direction.

As the piston 110 is advanced downhole via pressure on the piston head 417 as indicated above, the downhole anchor 180 may be centralized but not immobilized (as is detailed further in the anchor progression description below). Similar to that described above, the advancing uphole piston head 417 forces hydraulic fluid from the return chamber 413 of the uphole housing 102 through the fluid transfer line 480 to the downhole housing 115. Given the non-immobilizing nature of the downhole anchor 180, the influx of pressure into the downhole return chamber 416 results in the moving of the entire downhole housing 115 and anchor 180 in a downhole direction (see FIG. 6C). Thus, one by one, the anchors 170, 180 and housings 101, 115 continue to reciprocate their way downhole without requiring any interruption in the downhole advancement of the piston 110 or equipment pulled thereby.

As described above with reference to FIG. 3, communicative capacity with surface equipment may be extended downhole beyond the tractor 104. Additionally, as depicted in FIG. 4, hydraulic power may be extended beyond the tractor 104 as well. For example, a downhole tool 190 in the form of a clean out tool with a nozzle 175 may be provided. The nozzle 175 may be coupled to the supply line 400, for example to wash away debris 760 in the well 125 as depicted in FIG. 7.

Figure 5:
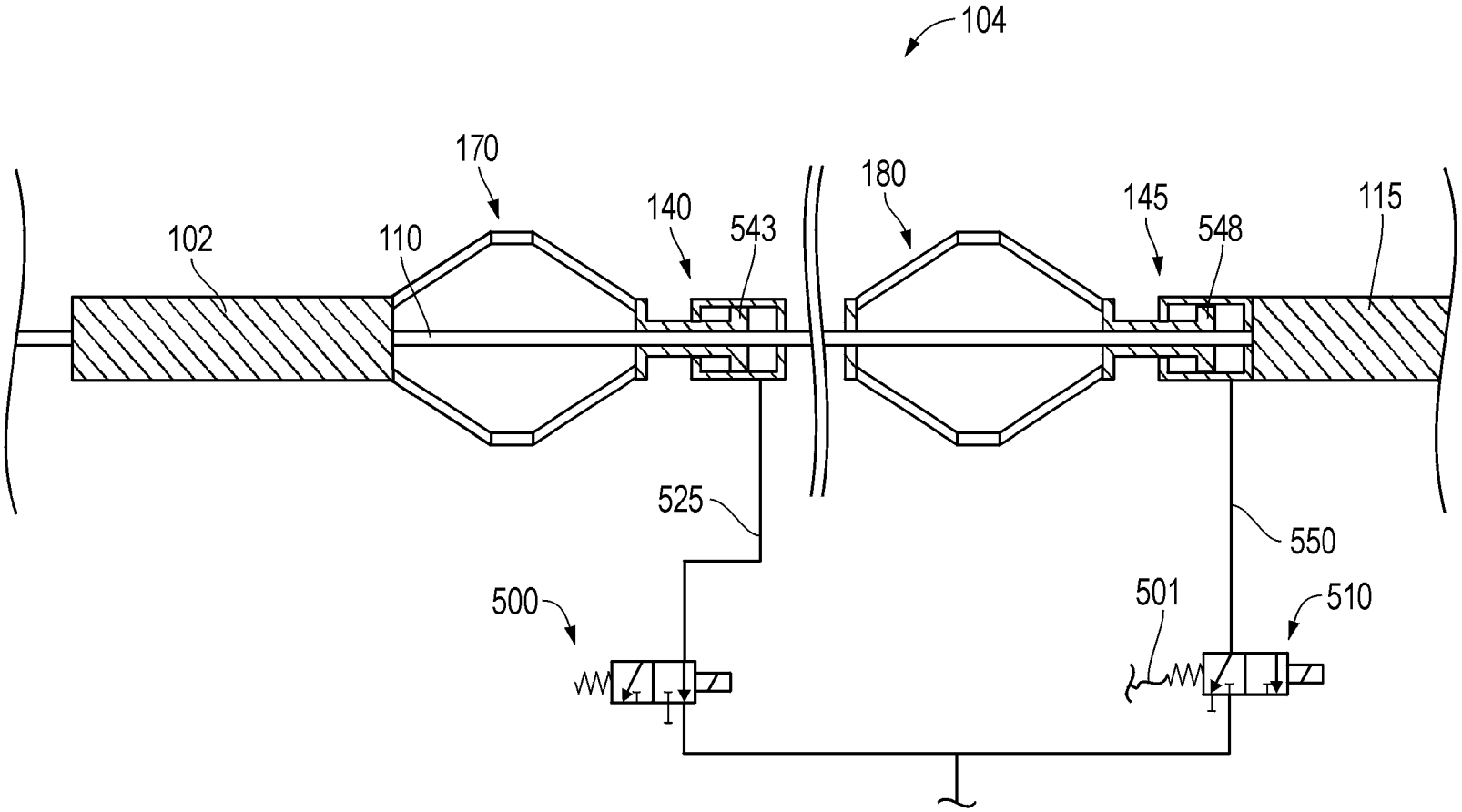
FIG. 5 is a side cross-sectional view of the tractor of FIG. 1 with a comparative depiction of anchoring hydraulics therebelow.

Continuing now with reference to FIGS. 4 and 5, the anchoring synchronization alluded to above is detailed. That is, as evidenced by the progression above, whenever an influx of high pressure is directed to the uphole side of a piston head 417, 419 (via 495 or 490), the associated anchor 170, 180 is immobilized. In other words, whenever the downhole pressurization line 495 pressurizes the downhole power chamber 415, the downhole anchor 180 is immobilized while the uphole anchor 170 remains laterally mobile (e.g. 'centralized' in the embodiments shown). Similarly, following the above noted pressurization switch, whenever the uphole pressurization line 490 pressurizes the uphole power chamber 411, the uphole anchor 170 is immobilized while the downhole anchor 180 becomes laterally mobile.

With reference to the downhole pressurization line 495 supplying high pressure to the downhole housing 115, the downhole anchor 180 may be immobilized with arms in a locked open position as noted above. Upon closer examination, the downhole actuator piston 548 of the downhole actuator 145 remains locked in place by the presence of the hydraulic fluid trapped within a closed off downhole actuator line 550. That is, with particular reference to FIG. 5, the downhole actuator line 550 is closed off by an anchor solenoid 510 that is employed to ensure that one of the anchors 170, 180 is immobilized at any given time. Wiring 501 may be provided to the anchor solenoid 510 from processing means associated with the position sensor 475 as well as the switch solenoids 402, 403 of FIG. 4. In this manner coordination between the immobilization of anchors 170, 180 and the pressure switch detailed with reference to FIG. 4 may be ensured. In particular, such coordination may include a tuned synchronization that maintains downhole movement of the tractor 104 during its operation and avoids any spring-back of coiled tubing in an uphole direction.

As shown in FIG. 5 and described above, the downhole actuator 145 is locked in place. However, at this same time the uphole actuator 140 is mobile in character. That is, the uphole actuator piston 543 is mobily responsive to radial displacement of the arms of the uphole anchor 170. Therefore, it may be laterally forced downhole in a centralized manner as detailed above. The mobility of the uphole actuator piston 543 is a result of its corresponding uphole actuator line 525 remaining open through the anchor solenoid 500. In this manner, the line may serve as an overflow or feed line wherein hydraulic fluid may be diverted to or from a pressure reservoir or other storage or release means below the solenoid 500.

Figure 6A:
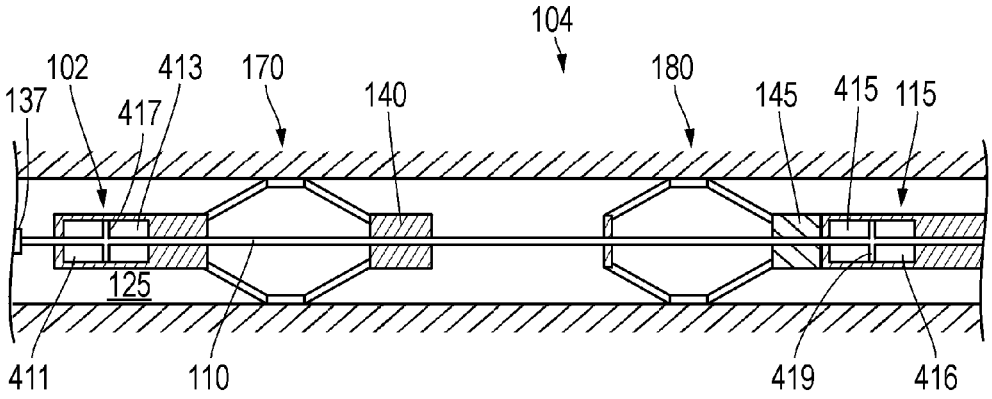
FIGS. 6A-6C are depictions of the assembly of FIG. 1 with fiber optically controlled hydraulically powered tractor movement from the position of FIG. 6A to the position of FIG. 6C.
Figure 6B:
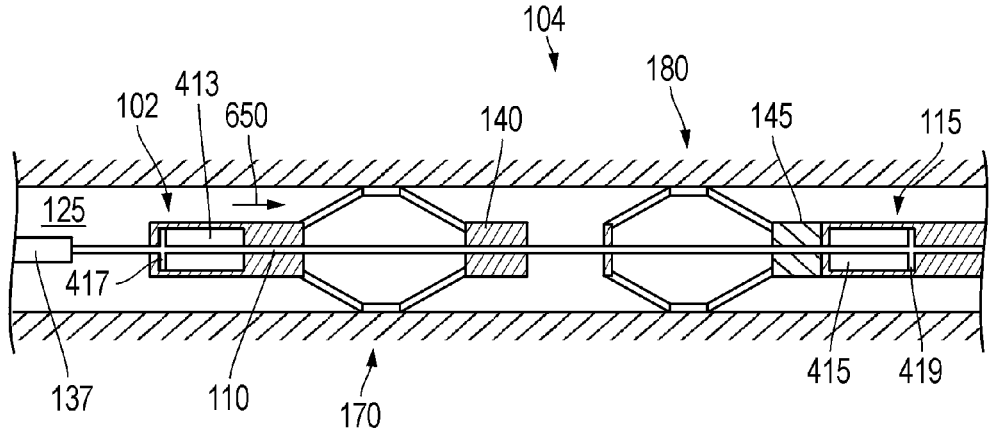
Figure 6C:
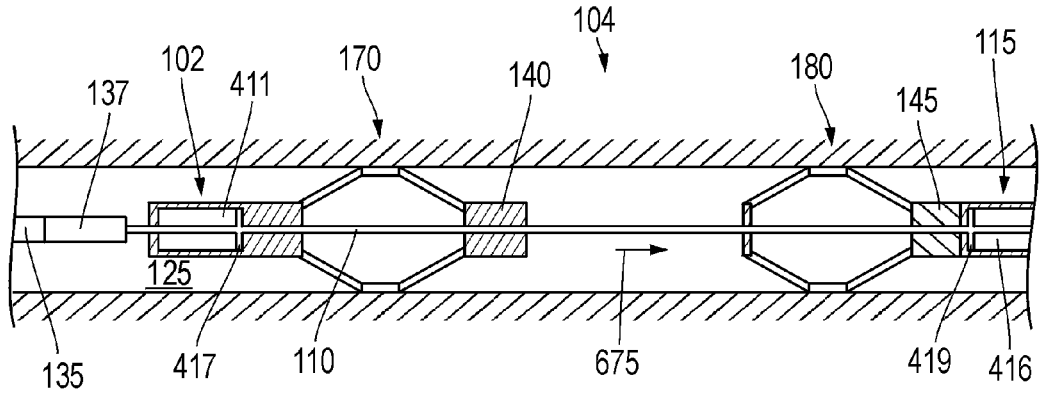

Referring now to FIGS. 6A-6C, the uninterrupted synchronization of anchoring and downhole reciprocating advancement of the tractor 104 is depicted. Starting with FIG. 6A, the tractor 104 is shown with the uphole anchor 170 and housing 102 distanced from the downhole anchor 180 and housing 115 within a well 125. The downhole actuator 145 is locked as described above such that the downhole anchor 180 is immobilized. Thus, pressure applied to the downhole power chamber 415 and on the downhole piston head 419 advances the piston 110 downhole (see FIG. 6B). At this same time, the uphole anchor 170 may be centralizing in nature, allowing for lateral mobility thereof along with the uphole housing 102 as also depicted below with reference to FIG. 6B.

Referring now to FIG. 6B, the noted lateral mobility of the uphole anchor 170 and housing 102 may be effectuated by the influx of pressure into the uphole return chamber 413. That is, given the minimal amount of force required to move the assembly 100, perhaps no more than about 300 PSI of pressure, a downhole movement thereof may be seen with reference to arrow 650. Of note is the fact that it is the downhole movement of the downhole piston head 419 that has lead to the influx of pressure into the chamber 413 thereby providing the downhole movement of the uphole anchor 170. Furthermore, while the uphole piston head 417 appears to move uphole, it is actually the uphole housing 102 thereabout that has moved downhole as indicated. Indeed, the entire piston 110 continues its downhole advancement without interruption as noted below with reference to FIG. 6C.

As shown in FIG. 6C, the uphole piston head 417 appears to resume downhole advancement relative to the uphole housing 102. However, as indicated above, the entire piston 110, including the uphole piston head 417 actually maintains uninterrupted downhole advancement. For example, once the switch solenoids 402, 403 change position from that shown in FIG. 4, the above described switch in pressure conditions occurs that leads to an influx of pressure into the uphole power chamber 411. At this same time, the uphole anchor 170 is immobilized by the locking of the uphole actuator 140 as detailed above. Therefore, the uphole piston head 417 is driven to the position of FIG. 6C, continuing the downhole advancement of the entire piston 110. Indeed, this downhole advancement of the uphole piston head 417 relative to the uphole housing 102 leads to an influx of pressure into the downhole return chamber 416. Thus, with the move to a mobile state of centralization of the downhole anchor 180 at this time, as detailed above, the downhole anchor 180 advances further downhole (see arrow 675) to the position shown in FIG. 6C.

As indicated, embodiments described herein allow for continuous downhole advancement of the piston 110. Thus, the load pulled by the piston 110, such as several thousand feet of coiled tubing or other equipment may be pulled while substantially avoiding resistance in the form of static friction. Downhole advancement of the load is not interrupted by any need to reset or reposition tractor anchors 170, 180. Thus, in the face of dynamic friction alone, the tractor 104 may be able to pull a load of up to about twice the distance as compared to a tractor that must overcome repeated occurrences of static friction. For example, where just under a 5,000 lb. pull is required to advance a load downhole, a 5,000 lb. capacity tractor of interrupted downhole advancement must pull about 5,000 lbs. after each interruption in advancement. Thus, as soon as the pull requirement increases to beyond 5,000 lbs. based on depth achieved, the tractor 104 may be able to pull the load no further. However, for embodiments of the tractor 104 depicted herein, even those subjected to a 5,000 lb. pull requirement at the outset of downhole advancement, the degree of pull requirement soon diminishes (e.g. to as low as about 2,500 lbs.). Only once the depth of advancement increases the pull requirement by another 2,500 lbs. does the 5,000 lb. capacity tractor 104 reach its downhole limit. For this reason, embodiments of tractors 104 described herein have up to about twice the downhole pull capacity of a comparable tractor of interrupted downhole advancement.

Referring now to FIG. 7, an embodiment of the bottom hole assembly 100 is depicted in the well 125 as described above. In the embodiment shown, coiled tubing 105 and other equipment are delivered to a downhole region 120 of an oilfield 700 by a delivery truck 701. The truck 701 accommodates a coiled tubing reel 703 and equipment for threading the coiled tubing 105 through a gooseneck 709 and injector head 707 for advancement of the coiled tubing 105 into the well 125. Other conventional equipment such as a blow out preventor stack 711 and a master control valve 713 may be employed in directing the coiled tubing 105 into the well 125 with the assembly 100 coupled to the downhole end thereof.

The assembly 100 is pulled through the deviated well 125 by its tractor 104 which also pulls along the coiled tubing 105 and intervening tools such as the diagnostic tool 137. A downhole tool 190 is also coupled to the assembly 100, for example, to clean out debris 760 at a downhole location 780 within the well 125. With added reference to FIG. 1, a fiber optic cable or tether 101 extends along with the coiled tubing 105 from the reel 703 at the surface of the oilfield 700. As detailed above, the fiber optic cable 101 disposed at the interior or fluid flow path 201 of the coiled tubing 105 may be employed for real time two way communication between surface equipment at the oilfield 700 (such as a data acquisition system 733) and downhole tools such as the diagnostic tool 137, the downhole tool 190, or even an activation solenoid 401 of the tractor 104 (see FIG. 4). Nevertheless, the pumping of hydraulic fluid through interior or fluid flow path 201 of the coiled tubing 105 during the operation is substantially unaffected by the presence of the fiber optic cable 101 due to its characteristics as detailed herein above.

Embodiments of the coiled tubing tractor assembly detailed herein above employ fiber optic communication through coiled tubing while also providing significant power downhole, for example, to a tractor that may be present at the downhole end of the coiled tubing. This is achieved in a manner that avoids use of large heavy conventional wiring running the length of the coiled tubing and potentially compromising the attainable depth or overall effectiveness of the coiled tubing operation.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments depicted herein reveal a two arm configuration for each anchor similar to that of U.S. App. Ser. No. 60/890,577. However, other configurations with other numbers of arms for each anchor may be employed. Furthermore, the foregoing description should not be read as pertaining only to the precise structures described and shown in the accompanying drawings, but rather should be read as consistent with and as support for the following claims, which are to have their fullest and fairest scope.

We claim:

1. A coiled tubing tractor assembly comprising:

a hydraulically driven coiled tubing tractor for substantially continuous advancement through a well, said tractor having a first housing about a first head of a piston, the first head for moving responsively to an influx of hydraulic pressure into the first housing, said tractor having a second housing about a second head of the piston to display moveable responsiveness to the moving of the first head relative to the piston;

a coiled tubing defining an interior fluid flow path coupled to said coiled tubing tractor, wherein fluid flowing from the surface of the wellbore along the fluid flow path provides the hydraulic pressure for the tractor;

a fiber optic tether disposed in the fluid flow path of the coiled tubing to provide a communicative pathway between surface equipment at the well and through the fluid flow path of the coiled tubing, the fiber optic tether negligibly affecting a movement of the hydraulic fluid through the coiled tubing; and a downhole tool coupled to the coiled tubing and positioned downhole of the coiled tubing tractor in the well, said downhole tool communicatively coupled to the fiber optic tether through the coiled tubing tractor by a signal converter for conversion of a fiber optic signal from the surface equipment to an electronic signal understood by said downhole tool.

2. The coiled tubing tractor assembly of claim 1 wherein said fiber optic tether is configured for controlling the advancement of the coiled tubing tractor and for transmission of data to and from the downhole tool.

3. The coiled tubing tractor assembly of claim 1 further comprising a diagnostic tool configured to acquire downhole measurements and coupled to said fiber optic tether.

4. The coiled tubing tractor assembly of claim 3 wherein the diagnostic tool is configured to acquire downhole measurements chosen from the group consisting of pressure, temperature, pH, particle concentration, viscosity, density, compression, tension, depth, location, and photographic information.

5. The coiled tubing tractor assembly of claim 1 wherein said downhole tool is configured for an application in the well which is one of a clean out application, a stimulation application, a fracturing application, a milling application, a fishing application, and a perforating application.

6. The coiled tubing tractor assembly of claim 1 further comprising electronic wiring coupled to the signal converter and the downhole tool.

7. The coiled tubing tractor assembly of claim 6 wherein the equipment is one of said coiled tubing tractor, a downhole tool coupled to said coiled tubing, and a diagnostic tool coupled to said fiber optic tether.

8. The coiled tubing tractor assembly of claim 6 further comprising a wireless transceiver coupled to an uphole end of said fiber optic tether for wireless exchange of the information with the surface equipment.

9. The coiled tubing tractor assembly of claim 1 wherein said hydraulically powered tractor further comprises:

a first anchor coupled to said first housing for immobilization thereof during the moving of the first head; and a second anchor coupled to said second housing to allow lateral mobility thereof for the responsiveness to the moving of the first head.

10. The coiled tubing tractor assembly of claim 1 further comprising a mobile battery coupled to one of said coiled tubing tractor, a downhole tool hydraulically coupled to said coiled tubing, and a diagnostic tool coupled to said fiber optic tether.

11. The coiled tubing tractor assembly of claim 1 wherein said fiber optic tether is less than about 0.01 pounds per foot, and less than about 0.15 inches in outer diameter, and wherein said coiled tubing is between about 1 and about 3 inches in inner diameter.

12. The coiled tubing tractor assembly of claim 1 wherein the hydraulic pressure is supplied by a closed loop hydraulic system.

13. The coiled tubing tractor assembly of claim 1 wherein the fiber optic tether enables a flow of fluid in the tractor to generate a pulling force of about 6000 watts.

14. A method of performing a coiled tubing operation comprising:

providing a coiled tubing defining an interior fluid flow path;

providing a fiber optic tether through the fluid flow path in the coiled tubing, the fiber optic tether comprising a fiber optic core encased in a protective jacket, the fiber optic tether negligibly affecting a movement of a hydraulic fluid through the coiled tubing;

coupling a hydraulically driven tractor to the coiled tubing;

establishing a communicative pathway along the fiber optic tether between surface equipment at the well and the coiled tubing tractor through the fluid flow path in said coiled tubing;

acquiring information relative to the well with a diagnostic tool that is coupled to the fiber optic tether extending through the coiled tubing tractor by a signal converter for conversion of a fiber optic signal from the surface equipment to an electronic signal understood by the diagnostic tool;

advancing the coiled tubing in a well with the hydraulically driven tractor, wherein advancing is controlled by signals carried along the fiber optic tether, and wherein the tractor is hydraulically powered by fluid flowing through the interior fluid flow path of the coiled tubing; and controlling the advancement and operation of the coiled tubing tractor and the operation of the diagnostic tool and surface equipment by employing the acquired information in real-time during the operation.

15. The method of claim 14 further comprising:

activating a downhole tool with the fiber optic tether, the downhole tool coupled to the coiled tubing and positioned downhole of the tractor; and employing the activated downhole tool for an application in the well.

16. The method of claim 14 wherein the hydraulically powered coiled tubing tractor is supplied hydraulic pressure by a closed loop hydraulic system.

17. The method of claim 14, wherein providing the fiber optic tether comprises providing a fiber optic tether that weighs no more than about 0.01 lbs./ft. and comprises an outer diameter of about 0.15 inches or less.

18. The method of claim 14, further comprising acquiring a distributed range of measurements across an interval of the wellbore with the fiber optic tether.

19. The method of claim 18, further comprising transmitting the acquired information to equipment at an oilfield surface.

20. The method of claim 14 wherein the fiber optic tether enables a flow of fluid in the tractor to generate a pulling force of about 6000 watts.

* * * * *